US008678262B2

(12) United States Patent
Zhou et al.

(10) Patent No.: US 8,678,262 B2
(45) Date of Patent: Mar. 25, 2014

(54) QUICK-CLAMPING MECHANISM FOR ELECTRIC HAMMER

(75) Inventors: Hongtao Zhou, Nanjing (CN); Jinhua Wu, Nanjing (CN); Liang Chen, Nanjing (CN); Guigong Ni, Nanjing (CN)

(73) Assignee: Chervon (HK) Limited, Hong Kong (HK)

( * ) Notice: Subject to any disclaimer, the term of this patent is extended or adjusted under 35 U.S.C. 154(b) by 432 days.

(21) Appl. No.: 13/006,553

(22) Filed: Jan. 14, 2011

(65) Prior Publication Data

US 2011/0174859 A1 Jul. 21, 2011

(30) Foreign Application Priority Data

| | | |
|---|---|---|
| Jan. 15, 2010 | (CN) | 2010 2 0022124 U |
| Feb. 2, 2010 | (CN) | 2010 2 0108147 U |
| Mar. 5, 2010 | (CN) | 2010 2 0125898 U |
| Apr. 30, 2010 | (CN) | 2010 1 0166104 |

(51) Int. Cl.
*B25C 7/00* (2006.01)

(52) U.S. Cl.
USPC ..... 227/144; 227/147; 227/149; 227/119; 227/113; 227/140; 279/56; 279/57; 279/58; 279/60

(58) Field of Classification Search
USPC ..... 227/144, 147, 149, 119, 113, 140; 279/56–58, 60; 81/402, 454, 455, 457, 81/459
See application file for complete search history.

(56) References Cited

U.S. PATENT DOCUMENTS

| | | | | |
|---|---|---|---|---|
| 1,425,359 | A * | 8/1922 | Barry | 81/53.2 |
| 2,670,215 | A * | 2/1954 | Fishwick | 279/38 |
| 2,938,266 | A * | 5/1960 | Klein, Jr. | 30/124 |
| 3,200,863 | A * | 8/1965 | Feldpausch | 81/57.42 |
| 4,003,417 | A * | 1/1977 | Cornwell | 81/57.37 |
| 5,897,045 | A | 4/1999 | Olvera et al. | |
| 7,234,376 | B2 * | 6/2007 | Bader | 81/55 |
| 7,399,101 | B2 * | 7/2008 | Clausen et al. | 362/119 |
| 2008/0054043 | A1 * | 3/2008 | Beales | 227/129 |

FOREIGN PATENT DOCUMENTS

| | | |
|---|---|---|
| EP | 1207017 A2 | 5/2002 |
| JP | 08108325 | 4/1996 |

* cited by examiner

*Primary Examiner* — Michelle Lopez
(74) *Attorney, Agent, or Firm* — Greenberg Traurig, LLP

(57) ABSTRACT

A quick-clamping mechanism for an electric hammer for clamping fasteners such as nails includes a biasing assembly for making the clamping assembly movable between a closed position and an opened position. The clamping assembly includes at least two clamping claws, pivotally connected to a pivot shaft including the combination of a torsion spring and a magnet. Fasteners such as nails and the like, can be clamped or released by the two clamping claws rotating relative to the pivot shaft, so that the quick-clamping mechanism has a simple structure and is easily implemented. The two clamping claws can be automatically closed, after a nail is loaded, by providing a torsion spring or a magnet on the two clamping claws, so that the quick-clamping mechanism can be operated expediently and the nail clamped securely.

8 Claims, 20 Drawing Sheets

D–D

QUICK-CLAMPING MECHANISM FOR ELECTRIC HAMMER

RELATED APPLICATION

This application claims the benefit of CN 201020022124.7, filed on 2010 Jan. 15, CN 201020108147.X, filed on 2010 Feb. 2, CN 201020125898.2, filed on 2010 Mar. 5, and CN 201010166104.1, filed on 2010 Apr. 30, the disclosures of which are incorporated herein by reference in their entirety.

BACKGROUND

This disclosure relates to a power tool, and more particularly, to an electric hammer which drives nails or other fasteners to enter into an object by a force provided by a striking device.

Electric hammers are electric tools which gradually strike fasteners such as nails into an object through the reciprocating movements of a striking device. The nails are required to be clamped by a clamping device while being stricken. The existing clamping device includes any one or any combination of jaws, springs, or chucks, which are provided to a housing of a power tool In order to strike fasteners such as nails into an object completely, the clamping device can move via a biasing device between a first position where the nail is clamped and a second position where the nail is released. However, existing clamping device have the disadvantages of insecure clamping, relatively complicated mechanism, huge volume and incompactness, etc.

SUMMARY

To overcome the existing disadvantages of currently known mechanisms, the present disclosure provides a quick-clamping mechanism for an electric hammer which has a good clamping effect and a compact structure. To this end, a quick-clamping mechanism comprises a clamping assembly, wherein the clamping assembly comprises at least two clamping claws which can be closed and opened and are pivotally connected to a pivot shaft.

In described embodiments, the quick-clamping mechanism may comprise a torsion spring for closing the two clamping claws, wherein two ends of the torsion spring are inserted into the two clamping claws, respectively; the two clamping claws may be provided with a magnetic element for closing the two clamping claws, respectively; the quick-clamping mechanism may also comprise a biasing assembly which acts on the clamping assembly so that the clamping assembly is biased towards a closed position of the two clamping claws; the biasing assembly may comprise a housing and a resilient element received within the housing; the resilient element may be a spring; the biasing assembly may also comprise a sliding sleeve mounted within the housing, wherein the sliding sleeve is slidable along the axial direction of the housing and can be restored to its initial position through the resilient element; and the biasing assembly may also comprise a bushing mounted within the sliding sleeve and connected to the sliding sleeve by using a mold insert.

As will become more apparent, with the above technical solutions, the following beneficial advantages can be obtained:

The two clamping claws are pivotally connected to the pivot shaft, and the fasteners such as nails and the like can be clamped or released by the two clamping claws pivoting relative to the pivot shaft, so that it has a simple structure which is easy to implement and the two clamping claws can be automatically closed, after the nail is loaded, by providing a torsion spring or a magnet on the two clamping claws, so that it can be operated expediently and clamped securely.

BRIEF DESCRIPTION OF THE DRAWINGS

FIG. 28 is a schematic view showing the configuration and relative position relationship of magnetic members on the clamping members of the sixth embodiment, wherein FIG. 28*a* is a schematic view showing that the magnetic members with different poles are located so as to attract each other when the two clamping members are in the clamped position, and FIG. 28*b* is a schematic view showing that the same poles of the magnetic members are located so as to repulse mutually when the two clamping members are in the released position;

DETAILED DESCRIPTION

Exemplary embodiments of subject clamping mechanism for use with an electric hammer will now be described with reference to the accompanying drawings.

Figure 1:
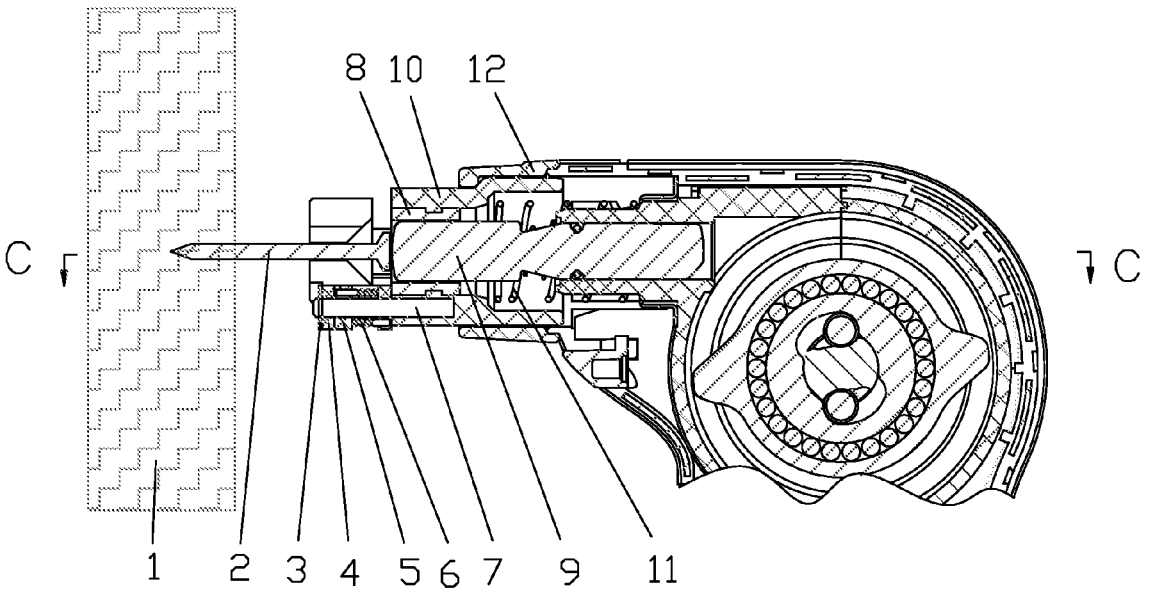
FIG. 1 is a schematic view of an exemplary quick-clamping mechanism for an electric hammer according to a first described embodiment.
Figure 2:
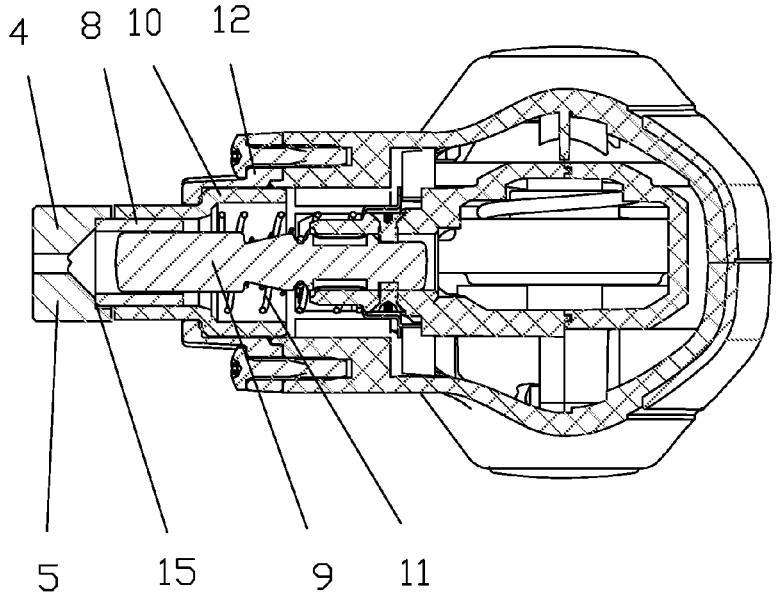
FIG. 2 is a cross-sectional view of the quick-clamping mechanism of FIG. 1 taken along line C-C.

As shown in FIG. 1 and FIG. 2, which are schematic views of a first embodiment of the quick-clamping mechanism, the quick-clamping mechanism generally comprises a clamping assembly for clamping nails and a biasing assembly for enabling the clamping assembly to be movable between a closed position and an opened position. The clamping assembly is composed of B clamping claw 4, A clamping claw 5, a torsion spring 6, and a pivot shaft 7, wherein the A, B clamping claws 5, 4 are pivotally connected to the pivot shaft 7, and the torsion spring 6 is mounted on the pivot shaft 7 with one end 61 inserted into the B clamping claw 4 and the other end 62 inserted into the A clamping claw 5 to realize the closed restoration of the clamping claws. The biasing assembly includes a bushing 8, a sliding sleeve 10, a spring 11, and a housing 12. After being mounted into the housing 12, the sliding sleeve 10 can slide within the housing 12 and can be restored by means of the spring 11. The bushing 8 and the sliding sleeve 10 are connected to each other by using a mold insert. The pivot shaft 7 and the sliding sleeve 10 are engaged by interference fit so that they can not rotate relative to each other. A snap spring 3 is provided on the left side of the A, B clamping claws to align the clamping claws axially. The snap spring 3 is locked on the pivot shaft 7. The A, B clamping claws abut at their right sides against the bushing 8. A nail 2 is clamped between the A, B clamping claws and may be nailed into a workpiece 1 under the action of a striking rod 9.

A V-shaped groove 14 for clamping the nail is provided in the middle of the engaging surfaces of the A, B clamping claws 5, 4 while being closed. A bevel 13 is provided on the top of the engaging surface of each clamping claw, and a V-shaped notch is formed by the bevels 13 on the top of the engaging surfaces of the clamping claws to allow the nail to be loaded. The right end of each of the clamping claw is provided a tapered guiding hole for the head of the nail, so that a circular hole is formed at the right end of the clamping claws by two tapered guiding holes. The circular hole has a diameter slightly larger than the diameter of the striking rod 9 for facilitating the striking rod 9 to press and then open the A, B clamping claws 5, 4 so as to strike the nail 2 wholly into the workpiece 1. Further, the A, B clamping claws 5, 4 are also provided on the right side thereof with a stepped face 15. The bushing 8 extends into the A, B clamping claws 5, 4 and abut at its left end against the stepped face 15, so that the bushing 8 serves to stop and align the A, B clamping claws 5, 4. The right end of the A, B clamping claws 5, 4 is spaced with a gap from the left end of the sliding sleeve 10, wherein the gap is used for passing the head of the nail therethrough while loading the nail. The bushing 8 is formed with a C-shaped sleeve at the gap which is a truncated section of an arc at the top to facilitate the head of the nail to be loaded.

The bushing 8 and the sliding sleeve 10 according to the present invention may be made in one piece, but preferably are connected to each other by using a mold insert. The bushing 8 is made of a hard material such as steel, while the sliding sleeve 10 is made of a soft material such as plastic. The bushing 8 can not only strengthen the sliding sleeve 10 locally but also enhance the wear resistance by reducing any abrasion caused by the striking rod 9.

Figure 3:
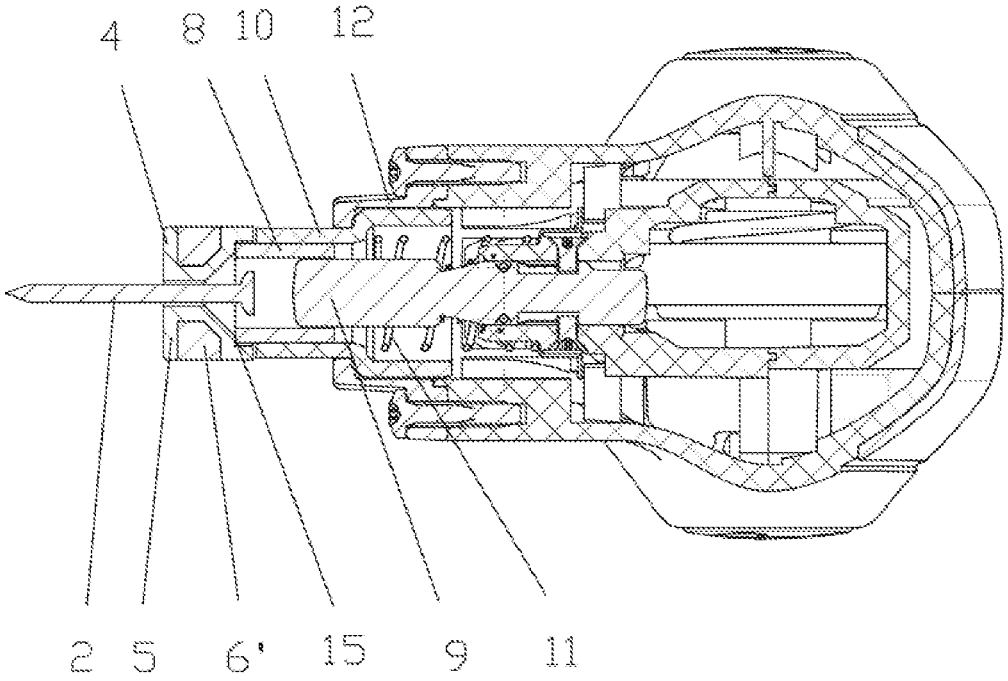
FIG. 3 is a schematic view of an exemplary quick-clamping mechanism for an electric hammer according to a second described embodiment.

A second embodiment of the quick-clamping mechanism is shown in FIG. 3. The clamping assembly of the quick-clamping mechanism is composed of the B clamping claw 4, the A clamping claw 5, the magnet 6', and the pivot shaft 7, wherein the A, B clamping claws 5, 4 are pivotally connected to the pivot shaft 7, and the closing and clamping motions of the A, B clamping claws 5, 4 are achieved by the attracting of the magnet 6'. The A, B clamping claws 5, 4 are provided at their respective outsides with a groove within which the magnets 6' are accommodated. The magnets 6' may be made separately or integrally with the clamping claws. The other assemblies and the relationship in position and connection are the same as those of the first embodiment.

The A, B clamping claws may also obtain an automatic closure by using a magnet and a torsion spring simultaneously.

The working principle of the quick-clamping mechanism for an electric hammer of the first and second embodiment is now explained in detail.

Figure 4:
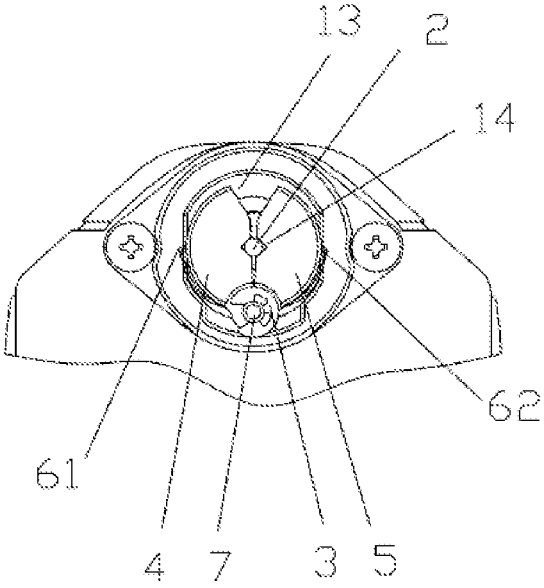
FIG. 4 is a side elevational view of the quick-clamping mechanism for an electric hammer according to the first and second embodiments.
Figure 5:
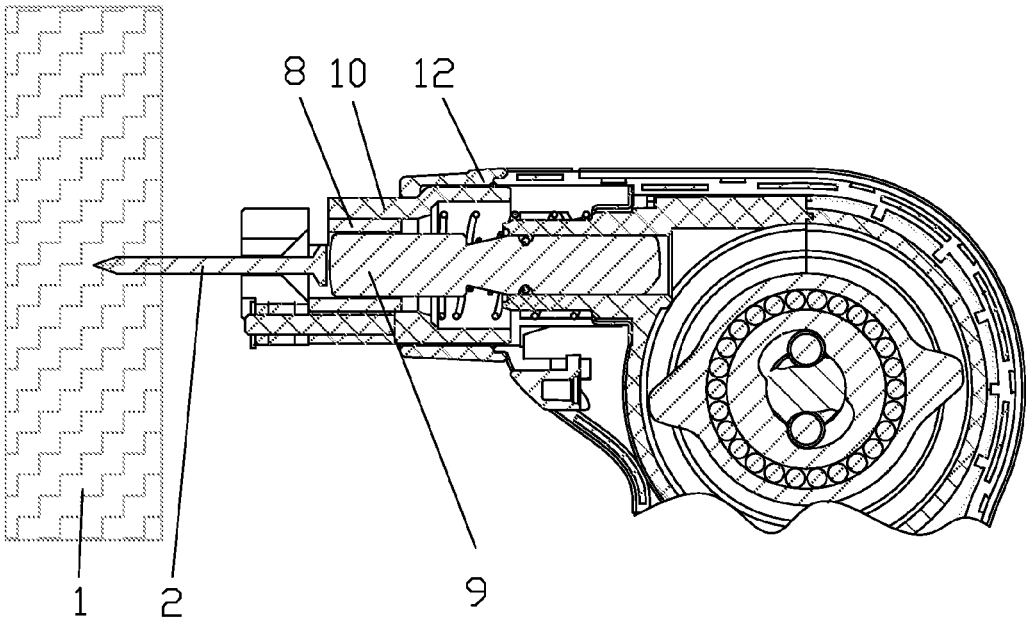
FIGS. 5 to 8 are the views illustrating the states of clamping and releasing nails through the quick-clamping mechanism in sequence according to the first and second embodiments.
Figure 6:
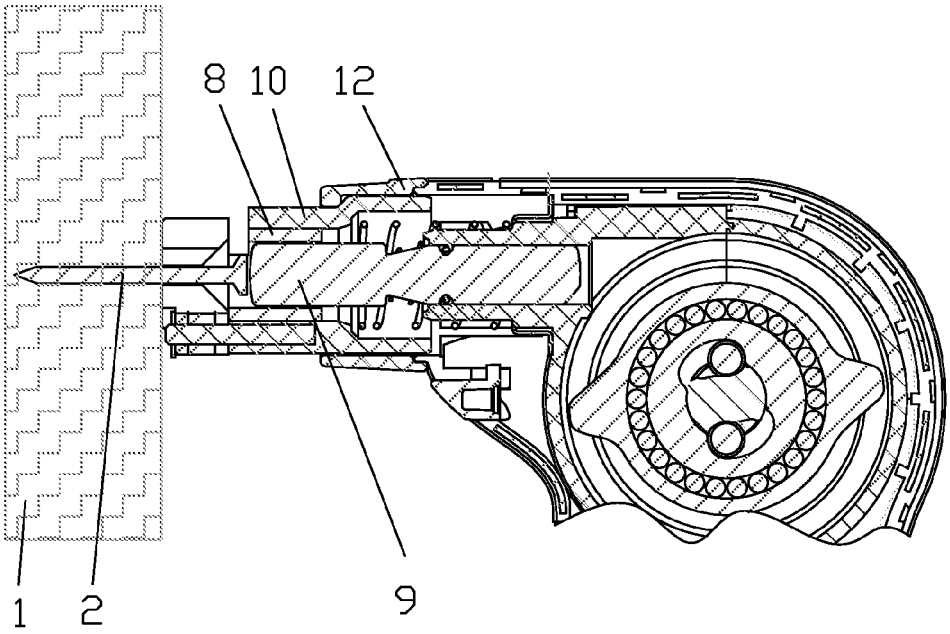
Figure 7:
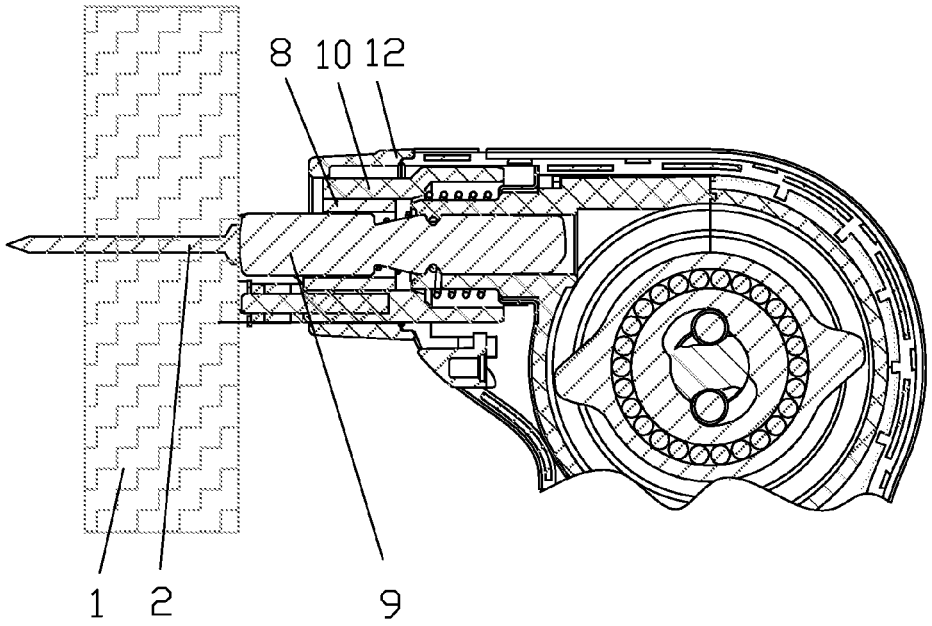
Figure 8:
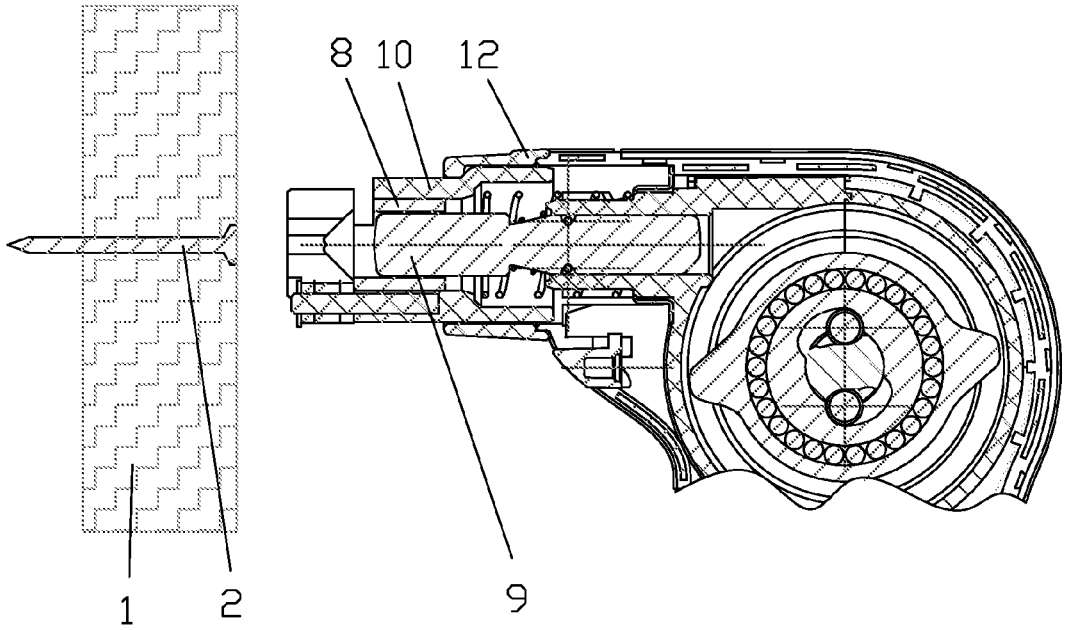

The sequence of loading the nail is explained with reference to FIG. 4, wherein the nail is loaded from above into a collet formed by the A, B clamping claws. First, the nail is loaded from the V-shaped notch formed on the top of the A, B clamping claws, then, the nail squeezes through the clamping claws and finally falls into the V-shaped groove in the middle of the clamping claws. As a result, an automatic aligning and clamping is achieved.

FIGS. 5 to 8 are the views illustrating the state of clamping and releasing nails through the quick-clamping mechanism in sequence. First, the nail is nailed into the workpiece while the workpiece does not contact the collet (FIG. 5); then, with the nail entering into the workpiece sequentially, the workpiece contacts the collet (FIG. 6), and consequently pushes the collet to move rightwards and causes the sliding sleeve 10 to retract into the housing, then the striking rod begins to push the clamping claws to move away from each other towards both sides. Finally, after the striking rod completely pushes away the clamping claws on both sides, the striking rod completely nails the nail into the workpiece (FIG. 7) and, after the nailing is finished, the collet moves from the surface of the workpiece, and the sliding sleeve is restored under the action of the spring force, and the A, B clamping claws are also restored automatically after moving away from the striking rod (FIG. 8), awaiting for the next cycle of operation.

In the following embodiments, the same reference numerals refer to the same or corresponding positions or members.

Figure 9:
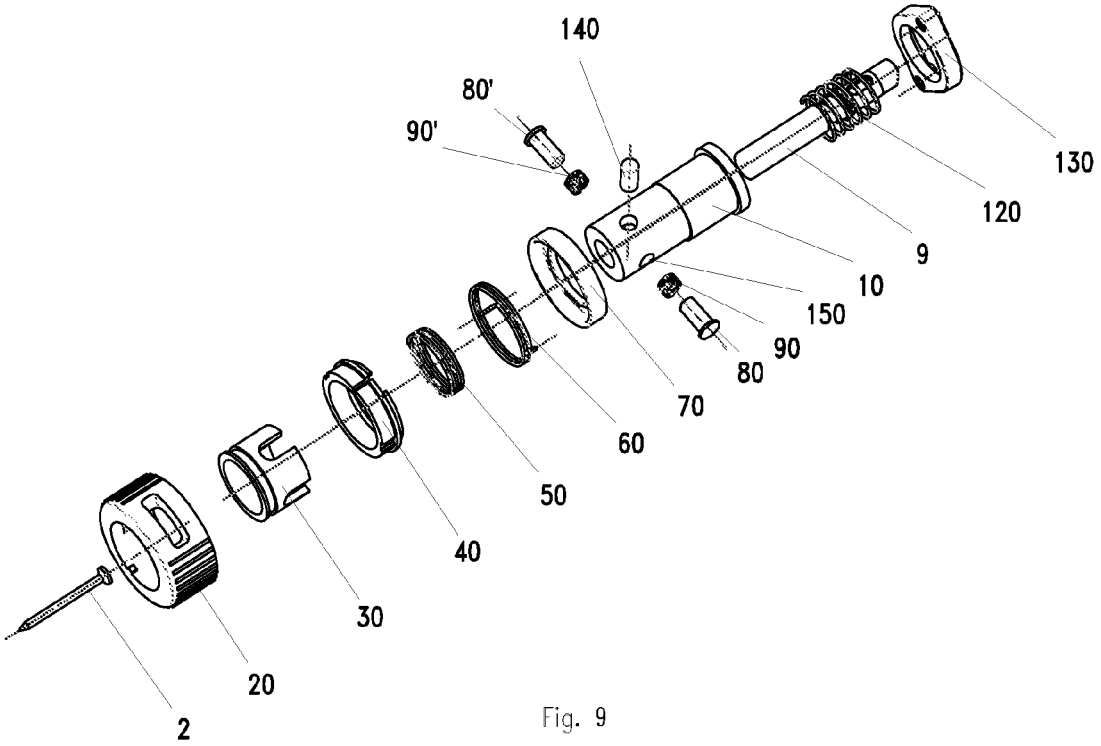
FIG. 9 is an exploded schematic view of an exemplary quick-clamping mechanism for electric hammer according to a third described embodiment.

As shown in FIG. 9, which is an exploded schematic view of an exemplary quick-clamping mechanism for an electric hammer according to a third embodiment, the quick-clamping mechanism comprises a turning sleeve 20, a bushing 30, a ferrule 40, a first spring 50, a torsion spring 60, a sheath 70, two clamping elements 80 and 80', two second springs 90 and 90', a sliding sleeve 10, and a third spring 120. The whole quick-clamping mechanism is mounted on a housing 12. By means of a striking rod 9, the nail 2 clamped within the quick-clamping mechanism may be stricken into the workpiece.

Figure 10:
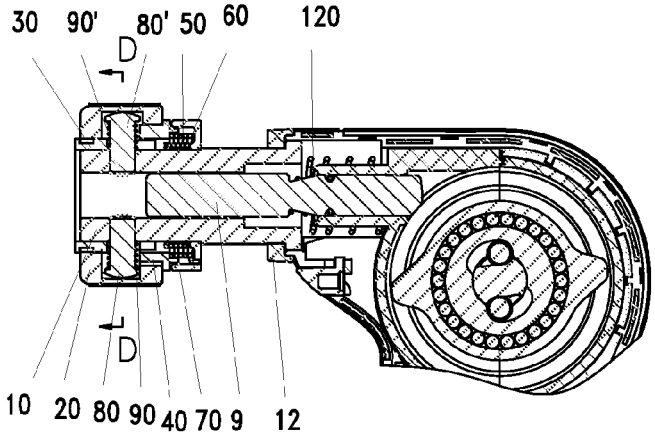
FIG. 10 is a schematic structural view illustrating the inner structure of the quick-clamping mechanism of the third embodiment.
Figure 11:
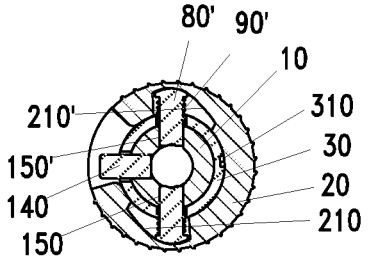
FIG. 11 is a cross-sectional view of the quick-clamping mechanism of FIG. 10 taken along line D-D.

As shown in FIG. 10 and FIG. 11, the sliding sleeve 10 is slidably mounted on the housing 12 and tends to slide frontwards by the third spring 120 acting on the rear end the sliding sleeve. The sliding sleeve 10 is unable to rotate circumferentially relative to the housing 12. The sliding sleeve 10 and the housing 12 are positioned with respect to each other by milling the curved surfaces to flat surface or by an engagement between a projection and a recess. The striking rod 9 can slide within the sliding sleeve 10 and be guided by the sliding sleeve 10. At least two radial holes 150, 150' are provided on the sliding sleeve 10 so that the clamping elements 80, 80' can go through them. The clamping elements 80, 80' extend into the circle center of the sliding sleeve 10 to achieve clamping, while the clamping elements 80, 80' is withdrawn in a direction opposite to the circle center of the sliding sleeve 10 to release the nail and vacate a space for passing the screw cap through.

The torsion spring 60 is secured at its one end by the sheath 70 so that it can not move relative to the sliding sleeve 10, and the sheath 70 is unable to rotate circumferentially relative to the sliding sleeve 10. The sheath 70 and the sliding sleeve 10 are positioned with respect to each other by milling the curved surfaces to flat surface or by an engagement between a projection and a recess, for axially positioning other units except for the sliding sleeve 10 and supporting the first spring 50 for pushing the bushing 30.

The ferrule 40 is a part connecting the sheath 70 and the turning sleeve 20. The ferrule 40 and the turning sleeve 20 are engaged with each other by means of a projection and a recess so that they can not rotate with respect to each other and the rotary force of the turning sleeve 20 is indirectly transferred into the torsion force of the torsion spring 60. Once the turning sleeve 20 is released, it can be restored automatically by the torsion spring 60.

Figure 14:
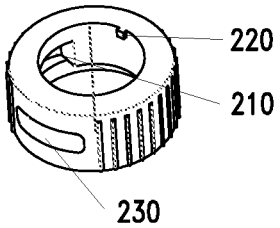
FIG. 14 is a perspective view of a turning sleeve of the quick-clamping mechanism of the third embodiment.

In conjunction with FIG. 11 and FIG. 14, two eccentric curved surfaces 210, 210' are provided on the turning sleeve 20. The distances of the two eccentric curved surfaces 210, 210' with respect to the axis center are maintained the same, that is, when the turning sleeve 20 rotates in one direction, the two clamping elements 80, 80', with one end thereof abutting against the two eccentric curved surfaces 210, 210' respectively, approach or keep away from the axis center of the sliding sleeve 10 simultaneously. Further, a projection 220 is provided on the front end of the inside surface of the sliding sleeve 20.

Figure 12:
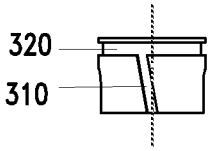
FIG. 12 is a schematic structural view of a bushing of the quick-clamping mechanism of the third embodiment.
Figure 13:
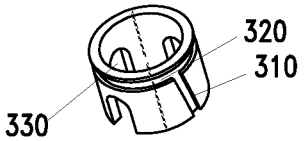
FIG. 13 is a perspective view of the bushing of the quick-clamping mechanism of the third embodiment.

Referring to FIG. 12 and FIG. 13, the bushing 30 is provided with an inclined slot 310 and an annular slot 320 or an annular step in communication with the front end of the inclined slot 310, preferably a circumferential slot 320. In the non-clamping position, the projection 220 of the turning sleeve is located in the annular slot 320 of the bushing, and the bushing 30 abuts at its rear end against the first spring 50, in this case, the first spring 50 is compressed. In the clamping position, the projection 220 of the turning sleeve is located in the inclined slot 310 of the bushing which is adapted for clamping and latching a nail 2 with different diameters. It will be understood that, the inclined slot 310 has an inclination angle smaller than the friction angle so as to enable the turning sleeve 20 to self-lock after rotating midway to stop. The turning sleeve 20 can not slide relative to the inclined slot 310, except that an external force is applied.

Each of the clamping elements 80, 80' of the third embodiment is further provided with a clamping element cap on one end that abuts against the eccentric curved surfaces 210, 210'. The second springs 90, 90' are covered on the clamping elements 80, 80'; both ends of the second springs 90, 90' are limited by stepped surfaces of the caps of the clamping elements 80, 80' and the outside surface of the sliding sleeve 10, respectively, so that the clamping elements 80, 80' automatically slide to the position where the eccentric curved surfaces 210, 210' has a maximum diameter.

In order to limit the circumferential rotation of the turning sleeve 20, a locating pin 140 is provided in the third embodiment. The locating pin 140 is pressed with interference into the sliding sleeve 10 and can slide within a circumferential hole 230 provided on the turning sleeve 20 and within an axial hole 330 formed on the bushing 3.

Herein below is the procedure of clamping and striking the nail by use of the quick-clamping mechanism of the third embodiment.

In the initial state, the sliding sleeve 10 extends out of the housing 12 to the longest extent under the action of the third spring 120. Under the action of the second springs 90 and 90', one end of each of the clamping elements 80, 80' abuts against the eccentric curved surface 210 and 210', and each of the clamping elements 80, 80' extends into the sliding sleeve 10 to the shortest extent. In this case, the projection 220 of the turning sleeve 20 is engaged in the annular slot 320 of the bushing 30, so that the bushing 30 compresses the first spring 50.

During the procedure of clamping the nail, the turning sleeve 20 is rotated while the nail is placed in position. At this time, the clamping elements 80, 80' slide towards the nail. When the turning sleeve 20 rotates to a certain angle, that is, to a position where the quick-clamping mechanism can clamp the nail with a maximum diameter, the projection 220 of the turning sleeve 20 faces the entrance of the inclined slot 310 of the bushing 30. Since the first spring 50 is initially in a compressed state, the bushing 30 is ejected by the first spring 50 under the action of the first spring 50. If the nail 2 has not been clamped yet, the turning sleeve 20 can be rotated continually, at this time, the projection 220 of the turning sleeve 20 slides downwards along the inclined slot 310 of the bushing 30 until the nail 2 is clamped firmly. There exists an angle between the inclined slot 310 of the bushing 30 and the axis of the bushing, so that the turning sleeve 20 can be self-locked and can not rotate relatively after the operator stops rotating the turning sleeve 20. As a result, a secure clamping is achieved.

During the procedure of striking a nail, in phase 1, the nail 2 is clamped firmly and then is slowly stricken into the workpiece by the striking rod 9, so that the workpiece gradually contacts the bushing 30, then the workpiece pushes the bushing 30 to retract into the quick-clamping mechanism. Once the bushing 30 is retracted fully, the projection 220 of the turning sleeve 20 slides out of the inclined slot 310 of the bushing and engages in the annular slot 320 of the bushing 30. In this case, there is no circumferential limit for the turning sleeve 20. As a result, the turning sleeve 20 rotates and restores to its initial state under the action force of the torsion spring 60. Accordingly, the clamping elements 80, 80' slide from the clamped position to the released position.

In phase 2, when the nail is stricken continually, the workpiece pushes the whole quick-clamping mechanism to move rightwards, and then the third spring 120 is compressed until the striking rod 9 extends out to the same plane as the workpiece.

After the procedure of striking the nail is finished, the hammer is lifted. At this time, the quick-clamping mechanism is restored under the action force of the third spring 120 and waits for the next working cycle.

Figure 15:
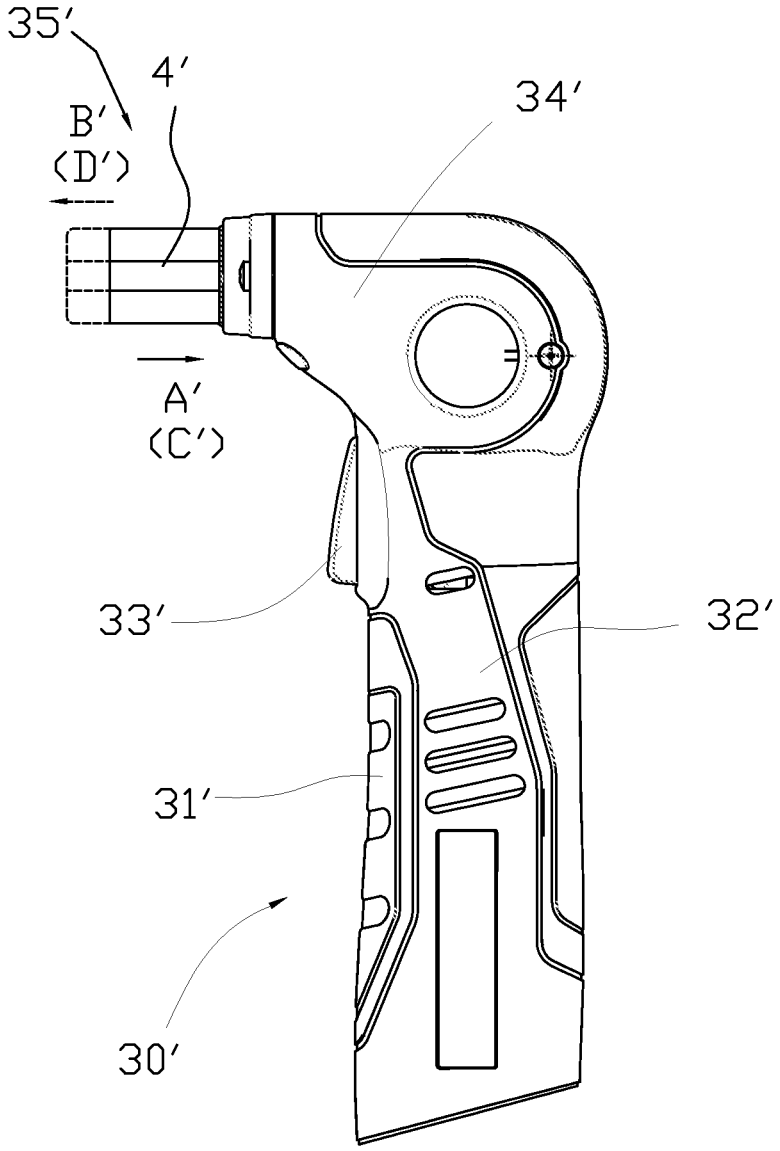
FIG. 15 is a schematic view of an exemplary quick-clamping mechanism for electric hammer according to a fourth described embodiment.

As shown in FIG. 15, which is a schematic view of an exemplary quick-clamping mechanism for an electric hammer according to a fourth embodiment, the main part 30' of the electric hammer mainly includes a body 32' and a striking head 34' positioned at the front end of the body 32'. The striking head 34' contains a striking element therein and a striking device which makes the striking element reciprocate. The body 32' accommodates a motor for driving the striking device and a transmission device (not shown), and forms a grip portion 31' substantially vertical to the striking head 34'. A switch 33' is arranged on the body 32' for controlling the motor which is supplied by a DC battery pack or a source of AC power. The quick-clamping mechanism 35' for the electric hammer is moveably mounted on the striking head 34' of the electric hammer.

Figure 16:
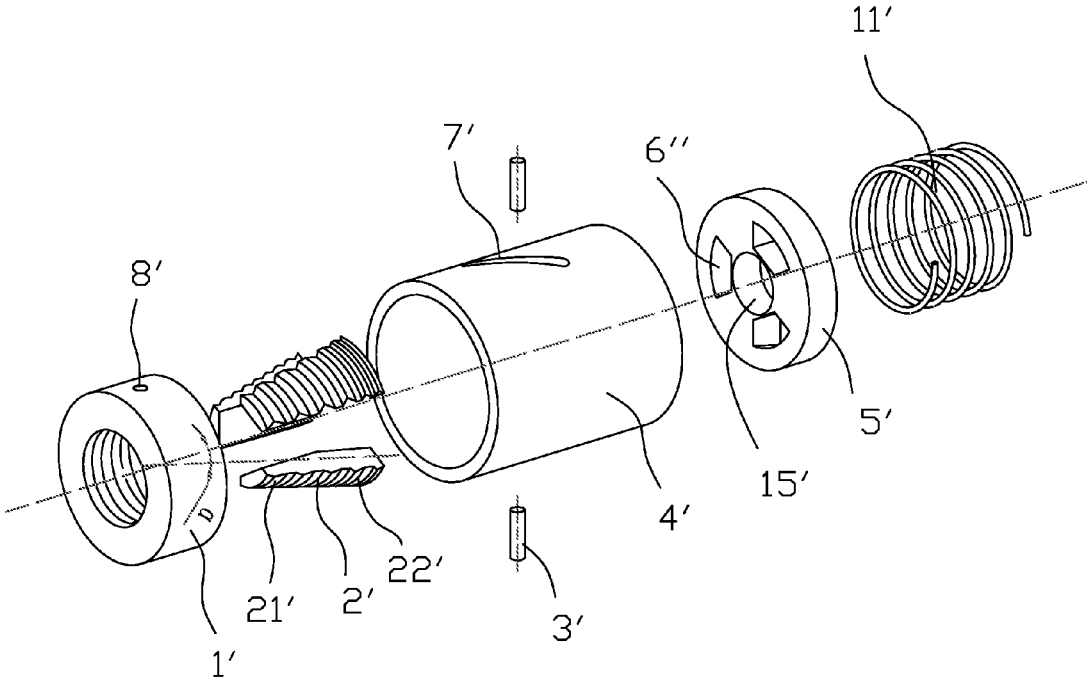
FIG. 16 is an exploded schematic view illustrating the components of the quick-clamping mechanism for the electric hammer of the fourth embodiment.

As shown in FIG. 16, which is an exploded schematic view illustrating the components of the quick-clamping mechanism for the electric hammer of the fourth embodiment. The quick-clamping mechanism mainly comprises the following components: an outer sleeve 4', an inner sleeve 1', a clamping element 2', a pin 3', and a retaining bracket 5'. It can be seen with reference to FIG. 1 that the outer sleeve 4' may move between a first position A' and a second position B' relative to the striking head 34'. At the first position A', the outer sleeve retracts back into the striking head and, at the second position B', the outer sleeve protrudes out from the striking head. In the third embodiment, a biasing means is further provided within the striking head 34' and acts on the outer sleeve 4', so that the outer sleeve 4' tends to move towards the second position B' to axially eject out from the clamping element. Preferably, the biasing means is a spring 11'.

At least two clamping elements, and in this embodiment, three clamping elements 2', are evenly arranged along the circumference of 360°. The clamping elements 2' are accommodated in the outer sleeve 4' and arranged at an inclination angle α relative to the direction of the axis of the outer sleeve 4'. The clamping elements 2 are driven by the outer sleeve 4' indirectly, and can move between a released position C' and a clamping position D' along the direction of the inclination angle α when the outer sleeve 4 moves between the first position A' and the second position B'. The tilted direction of the clamping elements 2' is configured so that the front ends 21' of the clamping elements 2' tend to be in close proximity to the axis, and the rear ends 22' of the clamping elements tends to depart away from the axis.

The inner sleeve 1' is mounted in the outer sleeve 4' and driven by the outer sleeve 4' with a linkage structure, so that the inner sleeve 1 can rotate at an angle when the outer sleeve 4' moves between the first position A' and the second position B'. The linkage structure is such that the outer sleeve 4' is opened with an inclined slot 7' in which a pin 3' may slide and the inner sleeve 1' is provided with a pin hole 8' in which the pin 3' may be interferentially pressed to fixedly connect with the inner sleeve 1'. When the outer sleeve 4' moves axially, the pin 3' slides in the inclined slot 7' to make the inner sleeve 1' rotate, that is to say, the axial movement of the outer sleeve 4' may be converted to the rotation movement of the inner sleeve 1' by the cooperation of the pin 3' and the inclined slot 7'. Those skilled in the art may easily conceive that the configurations of the inclined slot 7' and the pins 3' are not limited to the above preferred embodiment to convert the axial movement of the outer sleeve 4' into the rotation movement of the inner sleeve 1', namely, the object can be achieved by arranging the inclined slot 7' in the inner sleeve 1' and arranging the pins 3' in the outer sleeve 4'.

The inner sleeve 1' is threadly connected with the clamping elements 2', wherein the inner surface of the inner sleeve 1' is provided with threads and the outer surfaces of the clamping elements 2' are provided with threads which may be properly screwed up with the inner surface of the inner sleeve 1'. The clamping elements 2' can axially move upon the rotation of the inner sleeve 1', and can radially move relative to the center of the sleeve simultaneously due to the inclination angle α of the clamping elements 2' with respect to the axial direction of the sleeve, so as to move to the released position C' and the clamping position D', wherein the inner surfaces of the clamping elements 2' are used to clamp the nails.

The retaining bracket 5' is annular and includes an inner hole 15' through which the striking element 12' of the electric hammer for striking the nail can pass. The retaining bracket 5' is also provided with fixing holes 6" through which the clamping elements 2' can pass and slide, and the sectional shapes of the fixing holes 6" and the clamping elements 2' may ensure that the clamping elements 2' cannot rotate so as to obtain a reliable clamping.

Figure 23:
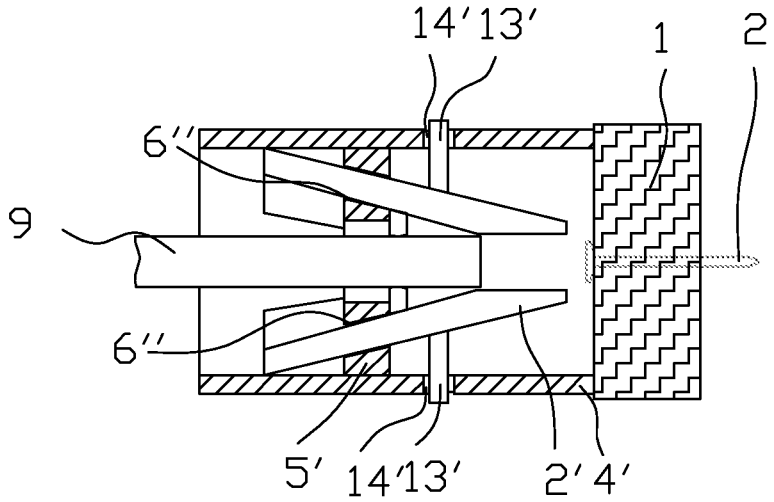
FIG. 23 is a schematic view illustrating an exemplary quick-clamping mechanism for the electric hammer according to a fifth described embodiment.

Shown in FIG. 23 are the inner structures of the quick-clamping mechanism for the electric hammer according to a fifth embodiment. The quick-clamping mechanism mainly includes the following components: an outer sleeve 4', a clamping element 2', and a retaining bracket 5'. It can be seen with reference to FIG. 15 that the outer sleeve 4' may move between a first position A' and a second position B' relative to the striking head 34'. At the first position A', the outer sleeve retracts into the striking head and, at the second position B', the outer sleeve protrudes out from the striking head. In this embodiment, a biasing means is further provided within the striking head 34' and acts on the outer sleeve 4', so that the outer sleeve 4 tends to move towards the second position B' to be axially ejected out from the clamping element. Preferably, the biasing means is a spring 11'.

At least two clamping elements, and in this embodiment, three clamping elements 2', are evenly arranged along the circumference of 360°. The clamping elements 2' are accommodated within the outer sleeve 4' and arranged at an inclination angle α relative to the direction of the axis of the outer sleeve 4'. The outer sleeve 4' or the clamping elements 2' can be provided with projections 13' vertical to the axis of the outer sleeve 4', and the other one of the outer sleeve 4' and the clamping elements 2' can be provided with corresponding holes 14' for passing the projections 13' there through. The clamping elements 2 are driven by the outer sleeve 4' directly, and can move between a released position C' and a clamping position D' along the direction of the inclination angle α when the outer sleeve 4' moves between the first position A' and the second position B'. The tilted direction of the clamping elements 2' is configured so that the front ends 21' of the clamping elements 2' tend to be in close proximity to the axis, and the rear ends 22' of the clamping elements tend to depart away from the axis.

The retaining bracket 5' is annular and has an inner hole 15' through which the striking element 12' of the electric hammer for striking nails can pass. The retaining bracket 5' is also provided with fixing holes 6" through which the clamping elements 2' can pass and slide, and the sectional shapes of the fixing holes 6" and the clamping elements 2' may ensure that the clamping elements 2' cannot rotate so as to obtain the reliable clamping.

The working process of the quick-clamping mechanism for the electric hammer of the fifth embodiment will now be explained.

Figure 17:
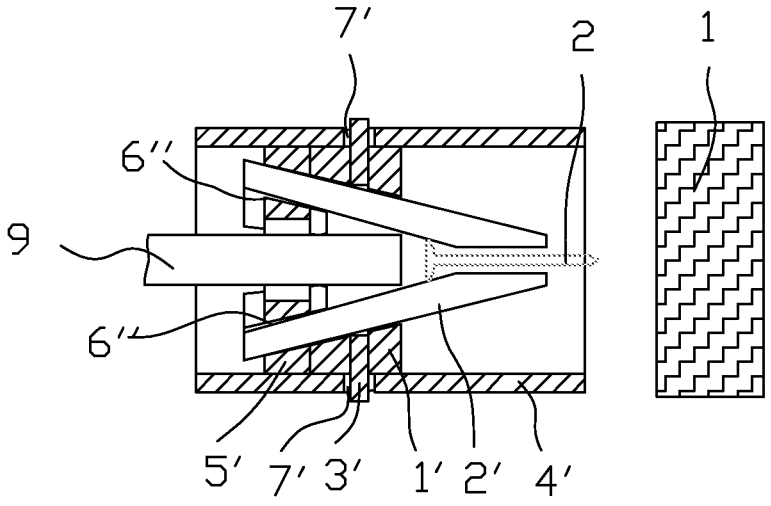
FIG. 17 is a schematic view illustrating the inner structures of the quick-clamping mechanism of the fourth embodiment, wherein the clamping elements are in the state for clamping a nail.
Figure 18:
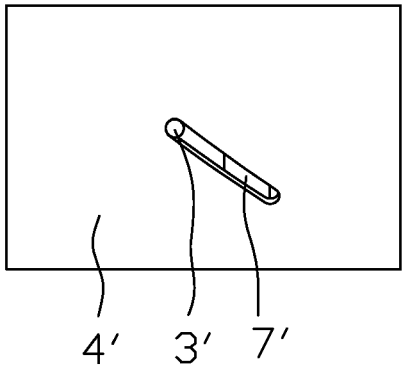
FIG. 18 is a view illustrating the outer structures of the quick-clamping mechanism of the fourth embodiment, wherein the clamping elements are in the state for clamping a nail.

Clamping the nails: an external force may be exerted to the outer sleeve 4' to enable the quick-clamping mechanism to retract back along the axial direction, and the inner sleeve 1' is rotated under the joint action of the inclined slot 7' and the pins 3' so that the clamping elements 2' retract back in the quick-clamping mechanism, and the front ends 21' of the clamping elements are opened for loading the nail 2; the outer sleeve 4' may be released to make it eject axially under the action of the biasing means, so that the clamping elements 2' become tight forward and the front ends 21' of the clamping elements may clamp the nail (seen in combination with FIGS. 16, 17 and 18).

Figure 19:
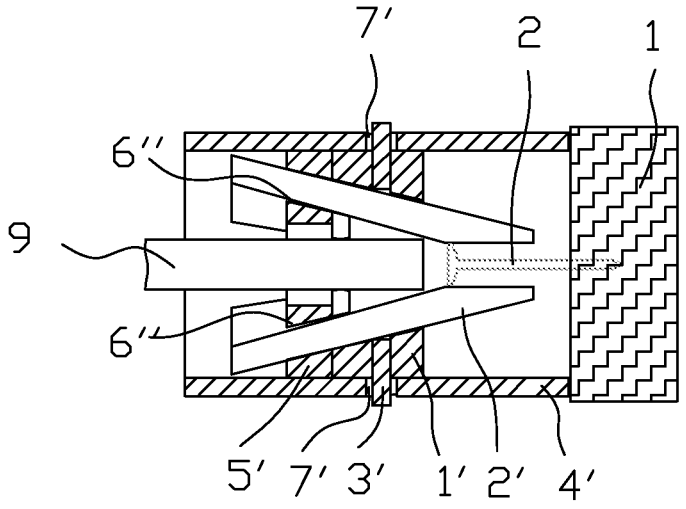
FIG. 19 is a schematic view illustrating the inner structures of the quick-clamping mechanism of the fourth embodiment, wherein the clamping elements are in the state for gradually releasing a nail.
Figure 20:
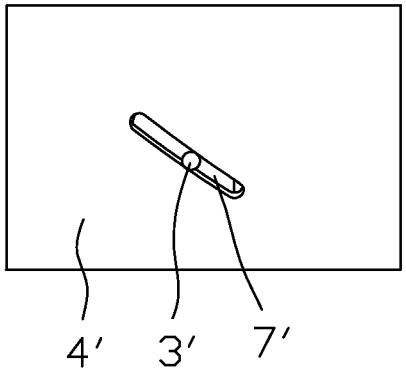
FIG. 20 is a view illustrating the outer structures of the quick-clamping mechanism of the fourth embodiment, wherein the clamping elements are in the state for gradually releasing a nail.

Striking the nails: when the nail 2 partially enters into the workpiece 1, the workpiece 1 gradually pushes the outer sleeve 4' to retract back in the quick-clamping mechanism, and then the inner sleeve 1' is rotated correspondingly so that the clamping elements 2' are retracted in the quick-clamping mechanism to slowly release the nail 2 (seen in combination with FIGS. 16, 19 and 20).

Figure 21:
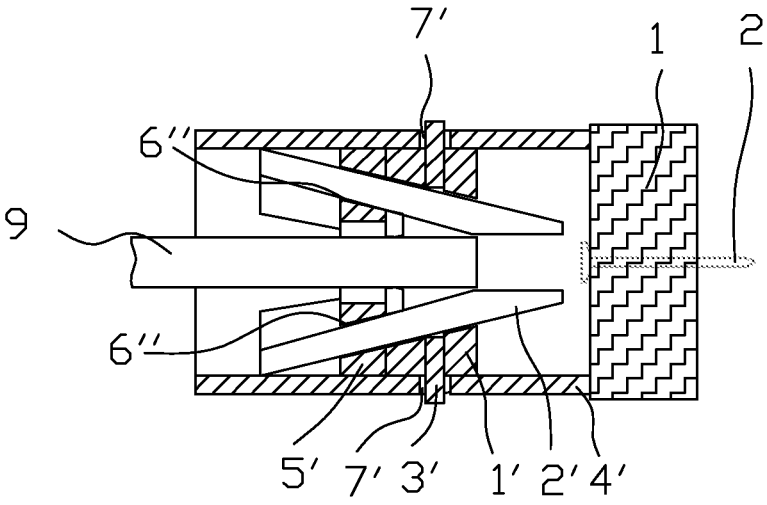
FIG. 21 is a schematic view illustrating the inner structures of the quick-clamping mechanism of the fourth embodiment, wherein the clamping elements are in the state for totally releasing a nail where the nail has been fully struck into a workpiece.
Figure 22:
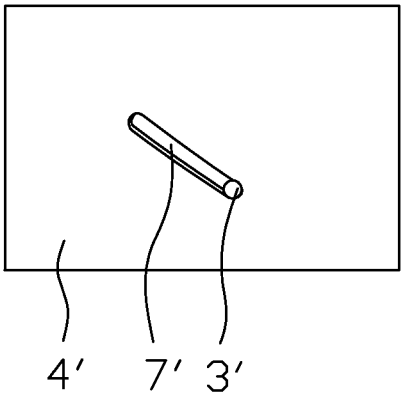
FIG. 22 is a view illustrating the outer structures of the quick-clamping mechanism of the fourth embodiment, wherein the clamping elements are in the state for totally releasing a nail where the nail has been fully struck into the workpiece.

Finishing a circle: the clamping elements 2' gradually release the nail 2 during the striking process, until the nail 2 is fully stricken into the workpiece 1 (seen in combination with FIGS. 2, 21 and 22).

Figure 24:
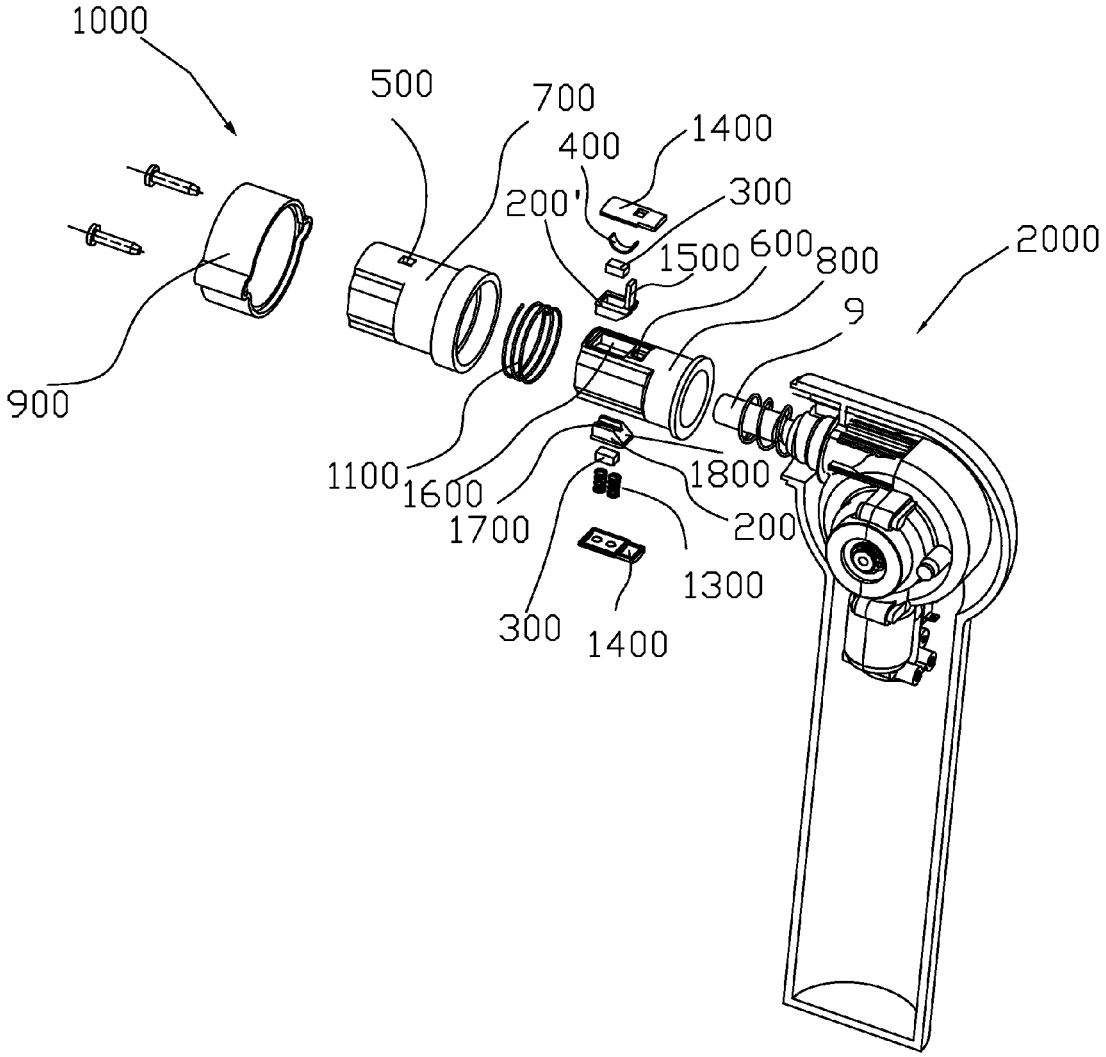
FIG. 24 is an exploded schematic view illustrating the components of the quick-clamping mechanism for the electric hammer according to a sixth described embodiment.
Figure 25:
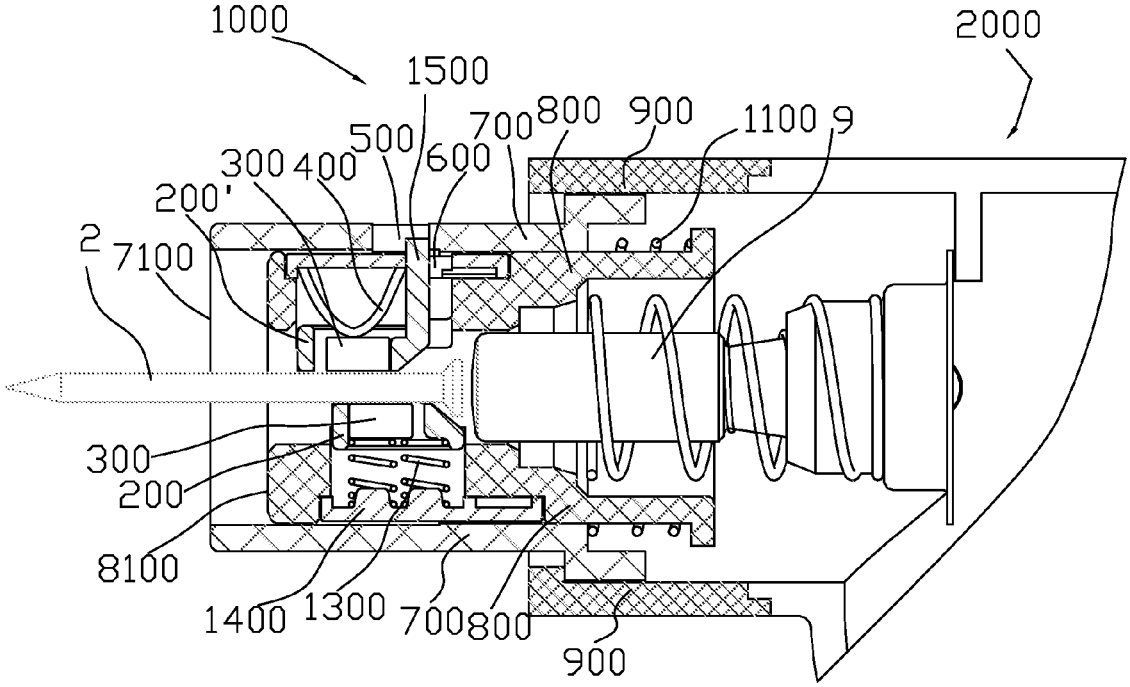
FIG. 25 is a sectional view of the quick-clamping device of the sixth embodiment, wherein two clamping members are in the clamped position whit a nail being clamped.
Figure 26:
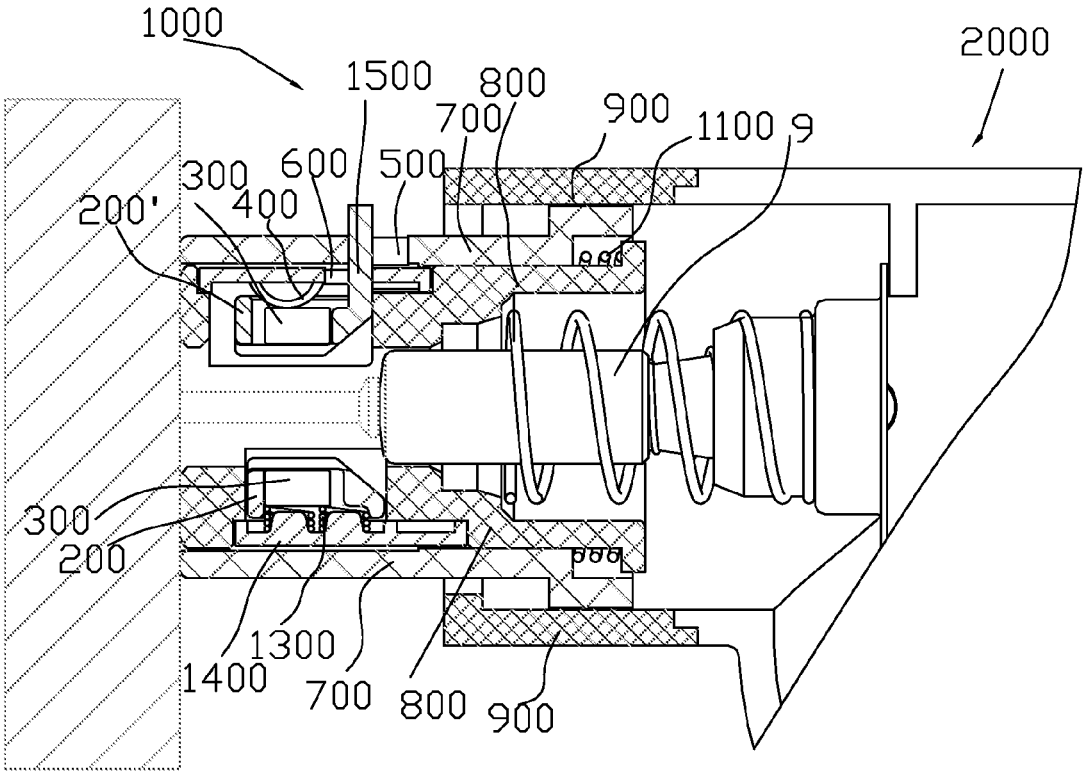
FIG. 26 is a sectional view of the quick-clamping device of the sixth embodiment, wherein the two clamping members are in the released position with a nail being released.

As shown in FIGS. 24-26, a quick-clamping device 1000 for an electric hammer of a sixth embodiment is mounted to a striking head 2000 of the electric hammer. The quick-clamping device includes two clamping members 200, 200' for clamping or releasing a fastener such as a nail 2. The striking head 2000 contains a striking rod 9 with reciprocating movement therein for acting on the fastener such as the nail 2. The two clamping members 200, 200' are provided with a magnetic portion 3 respectively, and have a clamped position (as shown in FIG. 25) where the nail is clamped by the clamping members 200, 200' attracting mutually via the magnetic portions 300 and a released position (as shown in FIG. 26) where the nail is released by the clamping members 200, 200' repulsing mutually via the magnetic portions 300.

Figure 28:
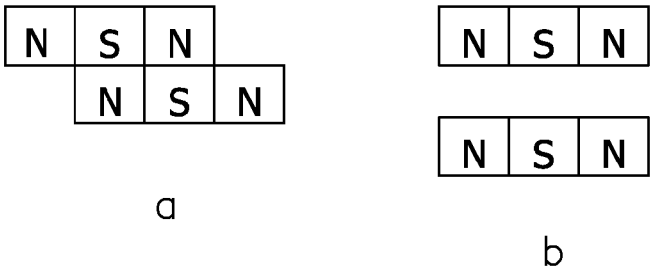
Figure 29:
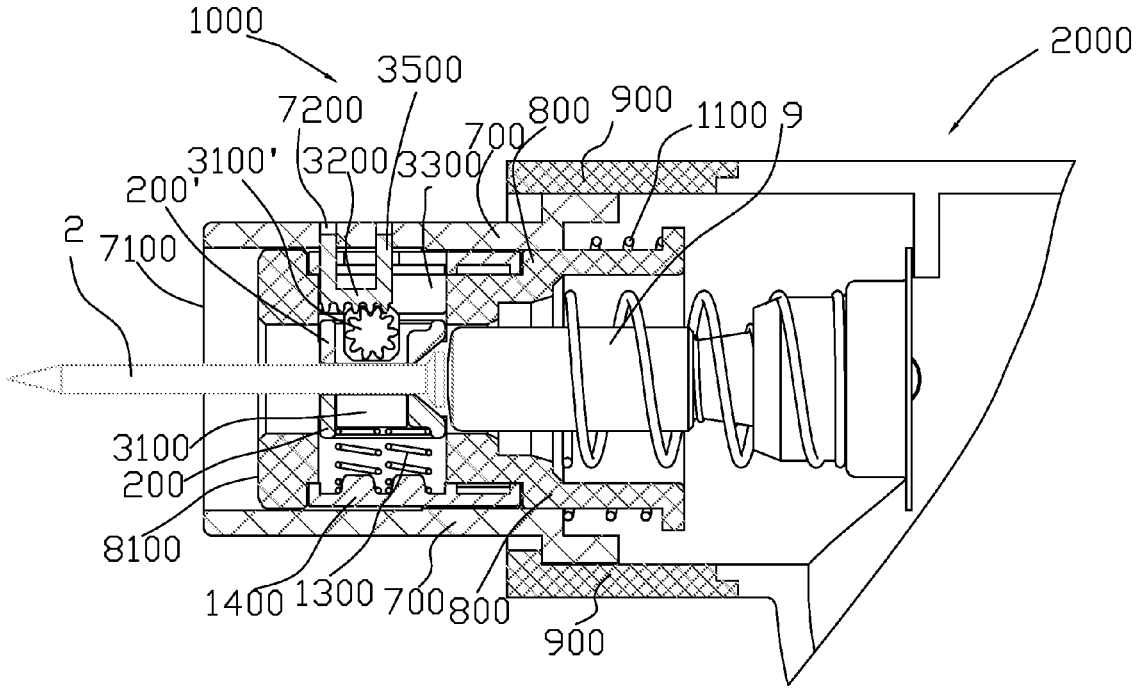
FIG. 29 is a sectional view of an exemplary quick-clamping mechanism for an electric hammer according to a seventh described embodiment, wherein the clamping members is in the position where a nail is clamped.
Figure 30:
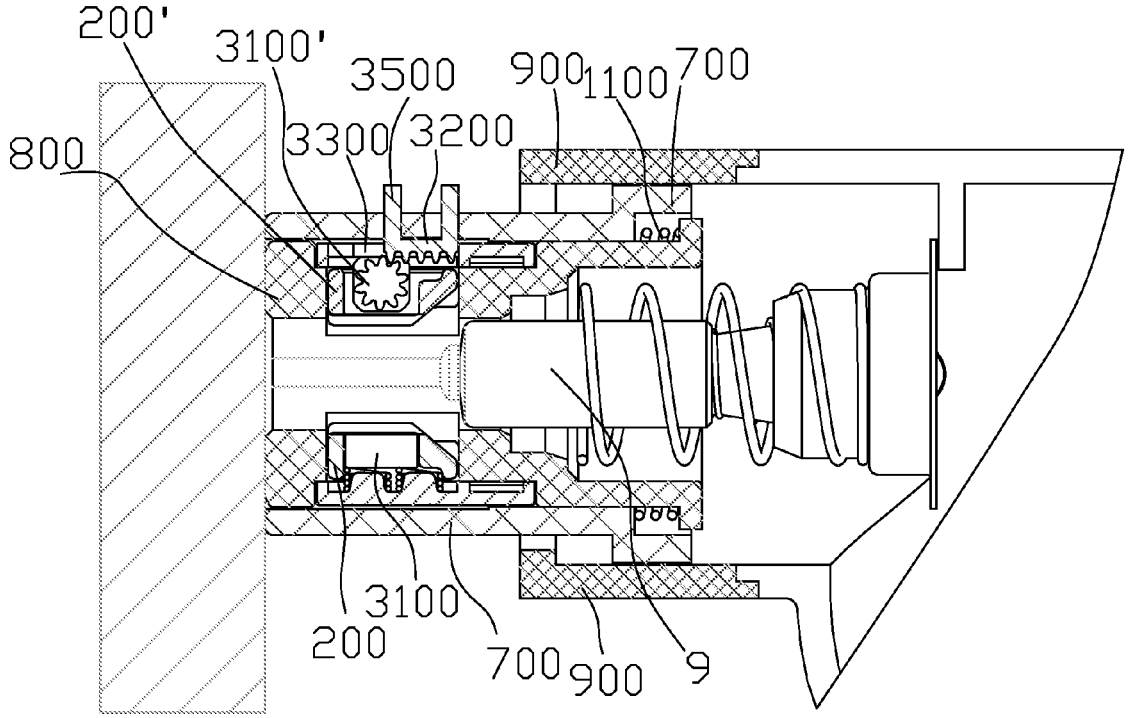
FIG. 30 is a sectional view of the exemplary quick-clamping mechanism for an electric hammer according to the seventh embodiment, wherein the clamping members is in the position where a nail is released.
Figure 32:
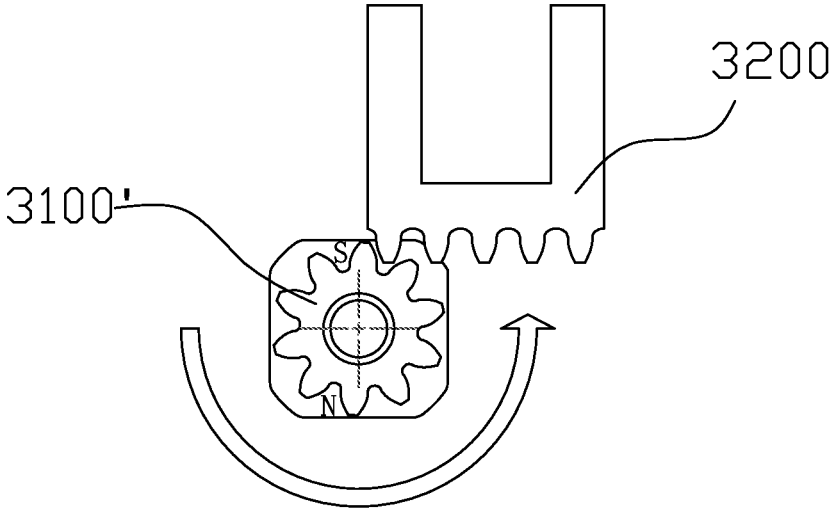
FIG. 32 is a schematic view of the exemplary quick-clamping mechanism for an electric hammer according to the seventh embodiment, wherein a gear on the clamping member driven by a rack is in a second position.
Figure 31:
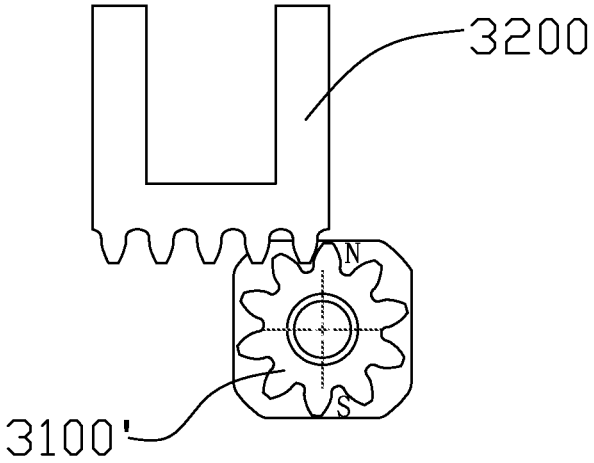
FIG. 31 is a schematic view of the exemplary quick-clamping mechanism for an electric hammer according to the seventh embodiment, wherein a gear on the clamping member driven by a rack is in a first position.
Figure 33:
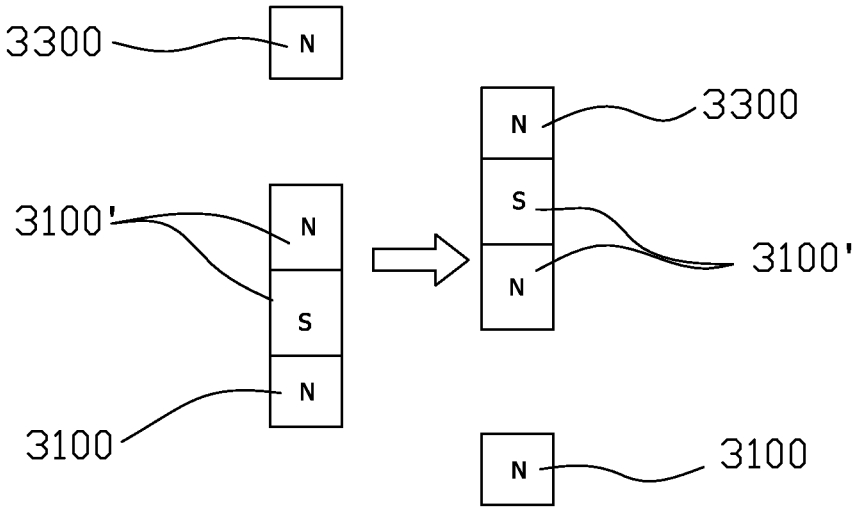
FIG. 33 is a schematic view of the exemplary quick-clamping mechanism for an electric hammer according to the sixth and seventh embodiments of the present invention showing the relative relationship of the poles of the magnetic members from the clamped position to the released position.

As shown in FIG. 28, the magnetic portion 300 is composed of one or more N pole magnetic units and one or more S pole magnetic units, wherein the N pole magnetic units and the S pole magnetic units are arranged separately from each other. When the two clamping members 200, 200' are in the clamped position, the N pole and S pole magnetic units of the magnetic portions 300 arranged on one clamping member 200' face the S pole and N pole magnetic units of the magnetic portions 300 arranged on another clamping member 200 respectively. When the two clamping 200, 200' are in the released position, the N pole and S pole magnetic units of the magnetic portions 300 arranged on the one clamping member 200' face the N pole and S pole magnetic units of the magnetic portions 300 arranged on the other clamping member 200 respectively.

Figure 27:
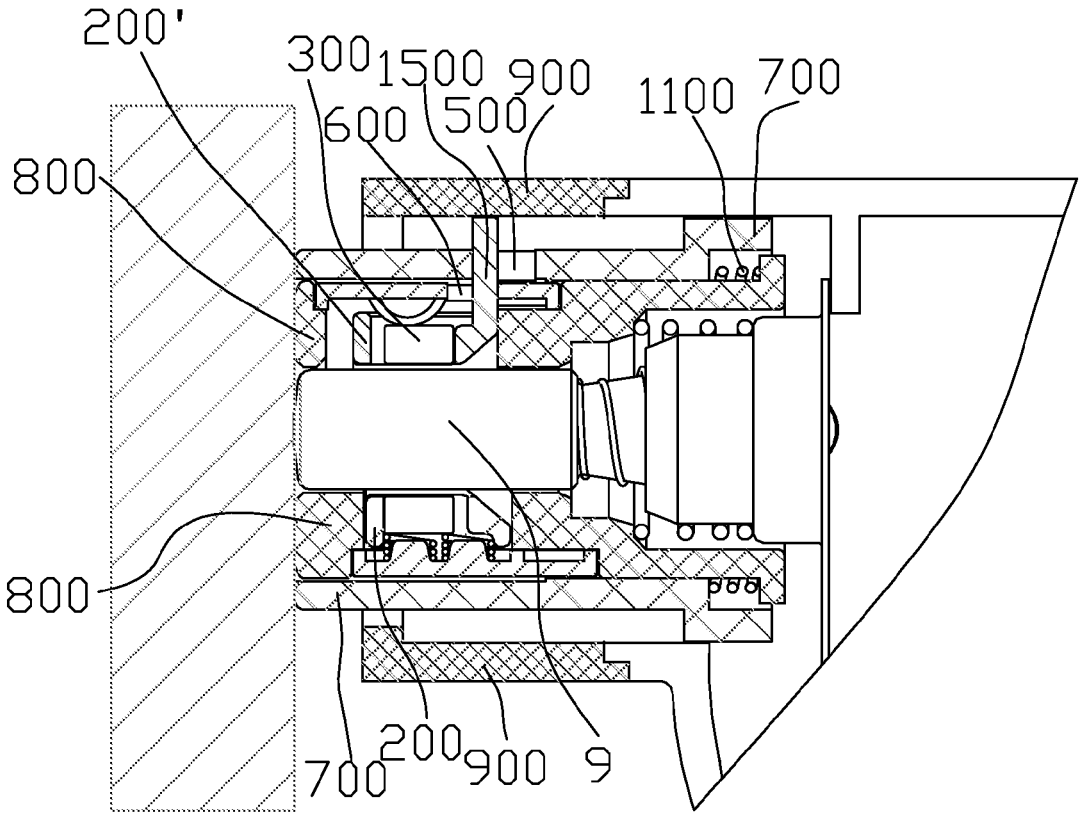
FIG. 27 is a sectional view of the quick-clamping device of the sixth embodiment, wherein the striking rod passes through the two clamping members to strike a nail fully into a work piece.

Referring to FIGS. 25-27, the two clamping members 200, 200' offset with each other in the direction of the reciprocating movement of the striking rod 9, so that the magnetic portions 300 with N pole and the S pole arranged alternately may attract mutually so as to bring the clamping members 200, 200' to clamp the nail, or repulse mutually so as to bring the clamping members 200, 200' to release the nail. In order that the one clamping member 200' may move along the direction of the reciprocating movement of the striking rod 9 relative to the other clamping member 200 that is fixed axially, an outer sleeve 700 is provided according to the invention, which may be movably connected to the striking head 2000. The outer sleeve 700 is provided with a first slotted hole 500 parallel to the direction of the reciprocating movement of the striking rod 9, and the one clamping member 200' is provided with a slide arm 1500 which passes through the first slotted hole 500 and may slide along the first slotted hole 500. An inner sleeve 800 is mounted within the outer sleeve 700 and is provided with a second slotted hole 600 parallel to the direction of the reciprocating movement of the striking rod 9. The slide arm 1500 arranged on the one clamping member 200' passes through the second slotted hole 600 and may slide therein. The first slotted hole 500 has a length substantially equal to the depth of the nail entering into the workpiece during the nail-clamping process from the moment that the front surface 7100 of the outer sleeve comes into contact with the surface of the workpiece to the moment that the outer sleeve 700 brings the inner sleeve 800 together to retract into the striking head 2000. The second slotted hole 600 mainly serves to provide a distance that the one clamping member 200' may move between the first position and the second position in the axial direction of the inert sleeve 800. This distance is substantially the relative displacement in the direction of the reciprocating movement of the striking rod 9 from the position where the different magnetic poles of the magnetic portions 300 of the two clamping members 200, 200' are opposed to the position where the same magnetic poles thereof are opposed. As can be seen from the above position relationship, the front surface 7100 of the outer sleeve extends beyond the front surface 8100 of the inner sleeve by an extending distance which is equal to or preferably larger than the distance between the first position and the second position. In the present embodiment, a sleeve supporting member 900 is mounted externally on the outer sleeve 700, and the outer sleeve may retract within the sleeve supporting member 900. The sleeve supporting member 900 is fixed to the housing of the striking head 2000 of the electric hammer by a fastener such as a nail. Additionally, a biasing elastic member 1100 is arranged between the outer sleeve 700 and the inner sleeve 800 for restoring the outer sleeve 700 automatically.

Referring to FIGS. 25-27, when the two clamping members 200, 200' are moved from the clamped position to the released position, a displacement in a direction vertical to the direction of the reciprocating movement of the striking rod 9 is formed besides the relative displacement in the direction of the reciprocating movement of the striking rod 9. For this purpose, the two clamping member 200, 200' of the present invention are movably mounted respectively within radial holes 1600 that are symmetrically arranged on the inner sleeve 800, and are supported by a first biasing member 400 in the from of a splinter and a second biasing member 1300 in the form of a spring respectively. In order to clamp the nail firmly, the surfaces of the two clamping members for clamping the nail are provided with a V-shaped groove 1700, respectively. In order to fully strike the fastener into the workpiece, the striking rod 9 needs to pass through and between the two clamping members 200, 200'. To reduce the resistance force therebetween, the clamping members 200, 200' are provided with a guide inclined surface 1800 on the side adjacent to the striking rod 9, respectively. Additionally, an encapsulation cap 14 is provided for encapsulating the clamping members 200, 200' and the biasing members within the inner sleeve 8.

The number of the clamping member need not be limited to two, and may be increased correspondingly for clamping more firmly.

Next, the work principle of the quick-clamping device for the electric hammer of the sixth embodiment will be explained.

When clamping the nail, the outer sleeve 700 is pushed by overcoming the biasing elastic member 1100. Once the left side of the first slotted hole 500 of the outer sleeve 700 abuts against the slide arm 1500 of the one clamping member 200', the outer sleeve 700 is further pushed so that the two clamping members 200, 200' reach the released position. In this case, the magnetic units of the magnetic members 300 with the same magnetic pole arranged on the two clamping members 200, 200' respectively are opposed, thus the two clamping members 200, 200' are moved to space a maximal distance by overcoming the action of respective elastic biasing members 400, 1300 respectively under the action of same magnetic poles repulsing. At this moment, the nail 2 may be put into place, the load exerted to the outer sleeve 700 is removed, thus the biasing member 1100 starts to restore. Under the action of the biasing member 1100, the outer sleeve 700 is ready to restore, and the right side of the first slotted hole 500 of the outer sleeve 700 abuts against the slide arm 1500 of the one clamping member 200' so that the magnetic units of the magnetic portions 300 with different poles on the two clamping members 200, 200' are opposed, thus the two clamping members 200, 200' attract mutually so as to clamp the nail under the action of different magnetic poles attracting mutually.

In operation, the front end of the outer sleeve 700 comes into contact with the work piece so that the supporting member 900 retracts inwards until the two clamping members 200, 200' are in the released position. In this case, the two clamping members 200, 200' are separated by the maximum distance, and both the nail 2 and the striking rod 9 can pass through the inner sleeve 800. After the operation is finished, the quick-clamping device 1000 may restore to its initial state since the load exerted to the outer sleeve 700 has been removed.

FIGS. 29-33 shows a seventh embodiment. Similar to the sixth embodiment, the clamping device also comprises an outer sleeve 700 which is movably connected to a striking head 2000. A sleeve supporting member 9 is mounted externally on the outer sleeve 700. An inner sleeve 800 is mounted within the outer sleeve 700. Clamping members 200, 200' for clamping or releasing fasteners such as a nail 2 is mounted on the inner sleeve 800.

The seventh embodiment differs from the sixth embodiment in that the two clamping members 200, 200' are provided with respective magnetic members 3100, 3100'. The magnetic polarity of the one magnetic member 3100 at the end towards the axle centre of the inner sleeve 800 is constant, while the other magnetic member 3100' is connected with a gear that is engaged with a rack 3200. The rack 3200 is provided with a plurality of cantilever arms 3500 that are connected to the outer sleeve 700, thus the rack 3200 can be moved between a first position and a second position in the axial direction of the inner sleeve 800 via the cantilever arms 3500 through the outer sleeve 700 moving with respect to the inner sleeve 800. Then, the gear is rotated and brings the poles of one magnetic member 3100' to be reversed in their magnetic polarity. As a result, it may be reversed to the released position in which the same magnetic poles of the magnetic members 3100, 3100' on the two clamping members 200, 200' are opposed from the clamped position in which the different magnetic poles of the magnetic members 3100, 3100' on the two clamping members 2, 2' are opposed.

The front surface 7100 of the outer sleeve protrudes beyond the front surface 8100 of the inner sleeve 800, thus the surface of the work piece may first come into contact with the front surface 7100 of the outer sleeve 700 in the process of striking the nail. As compared between FIG. 29 and FIG. 30, the extending distance may correspond to the distance that the rack 3200 moves between the first position and the second position.

The clamping members 200, 200' may be radially movably mounted to the inner sleeve 800 relative to the inner sleeve 800. The clamping members 200, 200' are provided with a biasing device for biasing the clamping members towards the axle centre of the inner sleeve 800 respectively. In the present embodiment, the biasing device acting on one clamping member 200' is an additional magnetic member 3300, while the biasing device acting the other clamping member 200 is a spring 1400. The pole direction of the additional magnetic member 3300 is constant, thus when the magnetic poles of the magnetic member 3100' on one clamping member 200' are reversed, the additional magnetic member 3300 may attract or repulse the magnetic member 3100'.

In other embodiments, the magnetic members and the clamping members may be formed integrally. Additionally, in order to clamp or release the nail by reversing the poles, it is not limited to arrange a magnetic member on the clamping member, and it may also use a magnetic inductive conductive coil for the same purpose.

What is claimed is:

1. A quick-clamping mechanism for an electric hammer having a housing comprising a clamping mechanism and an impact assembly, the clamping mechanism comprising:

a clamping assembly mounted on a sliding sleeve and moved with the sliding sleeve longitudinally with respect to the housing, the clamping assembly having at least two clamping claws which can be closed and opened wherein the two clamping claws are pivotally connected to a pivot shaft mounted to the sliding sleeve; and a torsion spring for closing the two clamping claws wherein two ends of the torsion spring are inserted into the two clamping claws, respectively.

2. The quick-clamping mechanism for an electric hammer according to claim 1, wherein the two clamping claws are each provided with a magnetic element for providing a closing force upon the two clamping claws.

3. The quick-clamping mechanism for an electric hammer according to claim 1, wherein the clamping assembly is movable between a closed position and an opened position of the two clamping claws.

4. The quick-clamping mechanism for an electric hammer according to claim 3, comprising a biasing assembly which acts upon the clamping assembly so as to enable the clamping assembly to tend towards the closed position of the two clamping claws.

5. The quick-clamping mechanism for an electric hammer according to claim 4, wherein the biasing assembly comprises a resilient element and a housing within which the resilient element is accommodated.

6. The quick-clamping mechanism for electric hammer according to claim 5, wherein the resilient element is a spring.

7. The quick-clamping mechanism for an electric hammer according to claim 5, wherein the biasing assembly is operatively coupled to the sliding sleeve mounted within the housing and wherein the sliding sleeve is slidable along an axial direction of the housing and is restorable to the closed position through the resilient element.

8. The quick-clamping mechanism for an electric hammer according to claim 7, wherein the biasing assembly further comprises a bushing which is mounted within the sliding sleeve and connected to the sliding sleeve by using a mold insert.

* * * * *